United States Patent [19]

Thomsen

[11] 4,280,663

[45] Jul. 28, 1981

[54] SCATTERING APPARATUS

[75] Inventor: Alfred Thomsen, Vejenvej, Denmark

[73] Assignee: A/S Alfred Thomsen, Vejenvej, Denmark

[21] Appl. No.: 56,105

[22] Filed: Jul. 9, 1979

[30] Foreign Application Priority Data

Jul. 7, 1978 [DE] Fed. Rep. of Germany ..... 2830056

[51] Int. Cl.[3] ..... E01C 19/20; E01H 10/00

[52] U.S. Cl. ..... 239/685; 222/614; 222/619; 222/624; 239/156

[58] Field of Search ..... 239/100, 155, 156, 685, 239/684, 157; 222/613, 614, 619, 620, 623, 624

[56] References Cited

U.S. PATENT DOCUMENTS

| | | | |
|---|---|---|---|
| 2,147,219 | 2/1939 | Seward | 239/685 |
| 2,407,628 | 9/1946 | Clark | 222/614 X |
| 3,019,025 | 1/1962 | Young | 239/685 X |
| 3,393,875 | 7/1968 | Bryant, Jr. | 239/685 X |
| 3,414,200 | 12/1968 | Savory | 239/156 X |
| 3,693,838 | 9/1972 | Haker et al. | 239/155 X |

FOREIGN PATENT DOCUMENTS

| | | |
|---|---|---|
| 1925849 | 7/1965 | Fed. Rep. of Germany . |
| 1982456 | 5/1967 | Fed. Rep. of Germany . |
| 453410 | 6/1968 | Switzerland . |
| 1163744 | 9/1969 | United Kingdom . |

*Primary Examiner*—Andres Kashnikow

*Attorney, Agent, or Firm*—Cushman, Darby, & Cushman

[57] ABSTRACT

A vehicle-mounted spreading apparatus includes a container for the material to be spread, at least one spreading disc rotatable about a vertical axis and a dosing device for conveying material from the container to the spreading disc as the vehicle moves along the ground. The disc and the dosing device are powered from a driving wheel which can be lowered into driving contact with the ground. The driving wheel conveys power to a mechanical power transfer assembly which drives the dosing device and which drives an adjustable speed motor system for the spreading disc.

12 Claims, 5 Drawing Figures

SCATTERING APPARATUS

The discovery involves a spreading apparatus for trucks, with a container from which the substance to be spread is released by means of a device which carefully regulates emitted amounts.

In order to strew large areas of roads, highways, airports, etc., with salt, gravel, chemicals, and so forth, apparatus of the afore-mentioned type are known. These apparatus are either detachable or undetachable from a truck or, for example from a tractor-trailer, from the trailer of a tractor-trailer rig or the like, which carries the weight of the substance to be spread as well as the apparatus itself. In these common apparatus, the spreading regulators—a strewing disc or the like—are powered either by an auxilliary motor such as a small diesel motor or by a hydraulic mechanism in the truck. In spreading on flat surfaces with the use of these apparatus, strewing in proportional relation to the area is desired, i.e., spreading as exactly and evenly a dosaged amount of substance per path and area unit as possible. For the apparatus commonly used this, however, requires the use of a very complicated control mechanism for powering the spreading regulator as well as the attachment of a distance meter such as an odometer wave hook-up or a tachometer generator hook-up to the truck. Also disadvantageous in the use of an apparatus powered by an auxilliary motor is that the production costs and operating costs are very high requiring complicated service and maintenance as well as causing additional environment damage because of the noisy motor and its exhaust fumes. Furthermore, in order to obtain an exact and dependable dosage, the propulsive power of the auxilliary motor has to be set relatively high so that it can continue functioning properly in the face of difficult conditions. In addition, there is the danger of breakage and malfunctioning, especially during winter use of the auxilliary motor and the strewing apparatus which applies particularly when leaving the motor running and for changes in the power of the motor when it is warming up.

Complicated alterations to the truck are required for an apparatus powered by a hydraulic mechanism of the truck. In this case as well, the propulsive power has to be set relatively high in order to achieve an exact and even dosage and therefore the hydraulic mechanism of the truck has to have larger dimensions. Additionally, the extra hydraulic hook-ups could especially lead to malfunctions if the strewing apparatus is supposed to be detachable or is supposed to be attached to the trailer. Complicated servicing and maintenance is also required for this common apparatus because of the necessarily comprehensive hydraulic mechanism.

The objective of the discovery is to create a centrifugal strewing apparatus which spreads on its areas in exact proportionality independent of the type of truck or tractor-trailer used and in the process is safe, environmentally acceptable, inexpensive in its production and operations and requiring little servicing.

In the discovery this task is solved by planning the use of a specially designed wheel at the end of the truck which can be lowered to the roadway and powers the spreading regulator by transferring the power gained thereby.

As a result, the strewing apparatus of this discovery receives its power from the rotating wheel and consequently maintaining exact proportionality to the area driven across. Thereby, an exact and even dosage is guaranteed with the use of this spreading regulator without making a complicated strewing apparatus or some other attachment or hook-up to the truck necessary. This is of particularly great advantage if a trailer is to be used as the vehicle or if the apparatus is designed to be detachable because the selection of the tractor-trailer or truck is completely independent of other factors. Therefore, it can be attached to any available truck without any special alterations or, if attached to a trailer, can be hauled by any type of rig. With regard to its use possibilities it is, therefore, extensively independent and flexible.

Furthermore, because a complicated spreading apparatus is no longer necessary because of the area-proportional drive, the power transfer device can be installed at a low cost and be safe whereby only minimal servicing and maintenance are required with a minimum of operating costs. Because of the thoroughly simple construction of the device there is hardly any danger of malfunctioning or breakage. Furthermore, the low noise level of the rotating wheel and the noise of the power transfer device present hardly any additional environmental disturbances.

For better results, the design of the discovery proposes to install the wheel in contact with the roadway close behind a back wheel of the truck so that it can roll over the surface already flattened out by it.

By attaching the rotating wheel behind the central side of the truck or by attaching a supporting wheel, which can be attached to make contact with the roadway with respect to the lateral center of the vehicle just as the rotating wheel, any conceivable disturbing disequilibrium to the sides of the truck can be avoided just as installation and dismantling are facilitated in the case of a detachable strewing apparatus.

For improving the grip of the wheel to the road it is best to equip it with a tire for downward pressure which can have a wide profile in correspondence with the operating conditions. Normal truck tires, which can be easily and inexpensively purchased, are suitable as tires. When using in special cases, such as fertilizing grass or the like, naturally very wide tires can be used which results in a safe grip for relatively little area pressure.

Another feature of the discovery is that the contact pressure between the rotating wheel and the roadway is adjustable. The result is an improved adjustment capacity to different types of usage. The downward pressure is advantageously adjustable so that it corresponds to an axis load of about 400 kg which is also common for a larger passenger vehicle tire.

For best results, the rotating wheel is attached to a compression leg which is secured to the rear on one of the frames of the apparatus. Such compression legs are common in various designs, as for example in airplane technology. A particularly simple and inexpensive design for the strewing apparatus of the discovery is that a column used as a compression leg is positioned vertically with a suspension arm attached to the end of the column at the opposite end of which the shaft of the rotating wheel is stored and which is designed for elasticity when in operation. Initial stress is obtained with particular ease and safety by the design of a pressure spring between the column and the wheel storage compartment. As a result, the contact pressure of the wheel to the roadway can be adjusted by lowering the pressure spring in the column. As minimal a vertical movement of the wheel as possible during strewing operations is achieved by positioning the suspension arm at the compression leg, which holds the wheel, away from the column. As a result, the wheel rolls as close behind the truck as possible where gradient changes have the least effect. A particularly advantageous feature of the apparatus with the compression leg made of the column and suspension arm with regard to costs and servicing is that the power transfer occurs from the rotating wheel across a first chain gear running alongside the suspension arm, a second chain gear running alongside the column, a corner pulley at the upper end of the column, and a shaft attached to the pulley which leads to an entry shaft of a drive mechanism of the power transfer device. The components used for this can be applied to other sections so that practically normed elements can be used. A changeover speed gear situated before the spreading regulator indicates another advantageous feature of the discovery with regard to the power transfer device. With this, spreading amounts, corresponding to given requirements and even to the width of the area to be strewn, can be regulated without adjusting the dosages at the spreading regulator in a simple manner by using a direct switch or a remote control switch such as electrical remote control. If a main coupling is placed before the change-over speed gear, this results in a considerable facilitation of operations because then spreading is done according to need by simply engaging or disengaging this main coupling without lowering the rotating wheel to the roadway or lifting it from the roadway. For personnel, particularly in winter, this is most beneficial if the main coupling can be operated by remote control from the driver's seat.

Another beneficial feature of the discovery's apparatus is that an overload coupling is used in the power transfer device in front of the change-over speed gear which disengages when a certain rotation is exceeded. Therefore, in case of a blockage in the total spreading mechanism, e.g. from a stone in the the substance to the spread, the power transfer from the wheel to the spreading mechanism is interrupted so that no damage occurs to the power transfer elements. Furthermore, this overload coupling allows for a weaker construction of the power transfer elements which is advantageous as far as costs and weight go.

Another feature of the discovery's apparatus is the design of an automatic switch gear in the power transfer device whereby the exit shaft always turns in the same direction even if the entry shaft is turning in a different direction. As a result, the safety of the apparatus is enhanced to the degree that the strewing mechanism will not break by driving it in the false direction as is the case for mandatory or unintentional reverse direction driving. Therefore, one can also spread when driving in reverse without any special alterations or conversions which can be of particular importance for slopes or dead-ends.

Beneficially, an oil pump is powered by the power transfer device which is attached to an oil motor for the spreading disc across an amount regulator. Because relatively lower power is needed for driving the spreading disc, this hydraulic drive mechanism for the spreading disc can be constructed inexpensively and safely. Because the spreading disc is located relatively far away from the main section of the apparatus and should also be adjustable, this hydraulic form of power transfer proves to be a simple feature on the basis of its flexibility with regard to the distance of power transfer. For this purpose, the oil pump is attached in front of the change-over speed gear in the power transfer device so that the spreading disc can be driven independently of a change in amounts by switching the change-over speed gear.

A particularly simple and robust feature of the spreading regulator of the spinning strewing apparatus lies in the fact that it has a convertible roll at the base of the strew substance container which opens up a rubber base of the container, pressed closed by adjustable springs when not in use, as it turns across the cogs situated there. The substance to be spread is then transported from the spreading regulator across a belt and a shaft into the spreading disc. As a result of drive synchronization between the belt and the spreading regulator and the convertible roll, the belt always receives the same amount of material which in turn allows for an even distribution of the substances and an optimal design of the belt. The belt is beneficially powered from behind, from the shaft to the end of the belt facing the spreading disc so that it is stretched and can be held without excess stretching in the same form. The substance is beneficially prepared by a mixing roll located in the substance container over the spreading regulator. By powering this mixing roll at a pre-determined rotation in proportion to the spreading regulator or convertible roll, the spreading regulator thereby receives a pre-dosage of the substance by means of the mixing roll.

For emptying the substance to be spread container in case of a change in substances the rotating wheel beneficially has an engagement shaft for shutting off the spin strewing apparatus. By engaging any type of available motor to this shaft—with the rotating wheel raised—the container can be emptied through the spreading regulator. Furthermore, in this manner the regulator or entire system can be checked while "standing in place". This type of engagement shaft can of course be also attached to any other element of the power transfer apparatus which, however, would require a corresponding lifting of the motor used. Engagement occurs in front of the automatic switch gear so that a power source of any rotation direction can be used; advantageously even in front of the overload coupling so that any unforeseen blockage to a portion of the strewing apparatus does not destroy the power source and the elements of the power transfer device. For this purpose, the strewing apparatus is equipped advantageously with an electronic or hydraulic auxilliary motor, powered externally, for powering the power transfer device while not in motion.

A further increase in the independence of the strewing apparatus when used is an advantageous result of the fact that the rotating wheel drives a generator and/or air pump. As a result, after storing power, electricity for lighting, remote control or the like, or pressurized air for powerized functions, as well as direct use of electricity or pressurized air can be obtained when in motion for normal purposes.

Below, the discovery is depicted with the use of an example and with reference to the illustrations:

Figure 1:
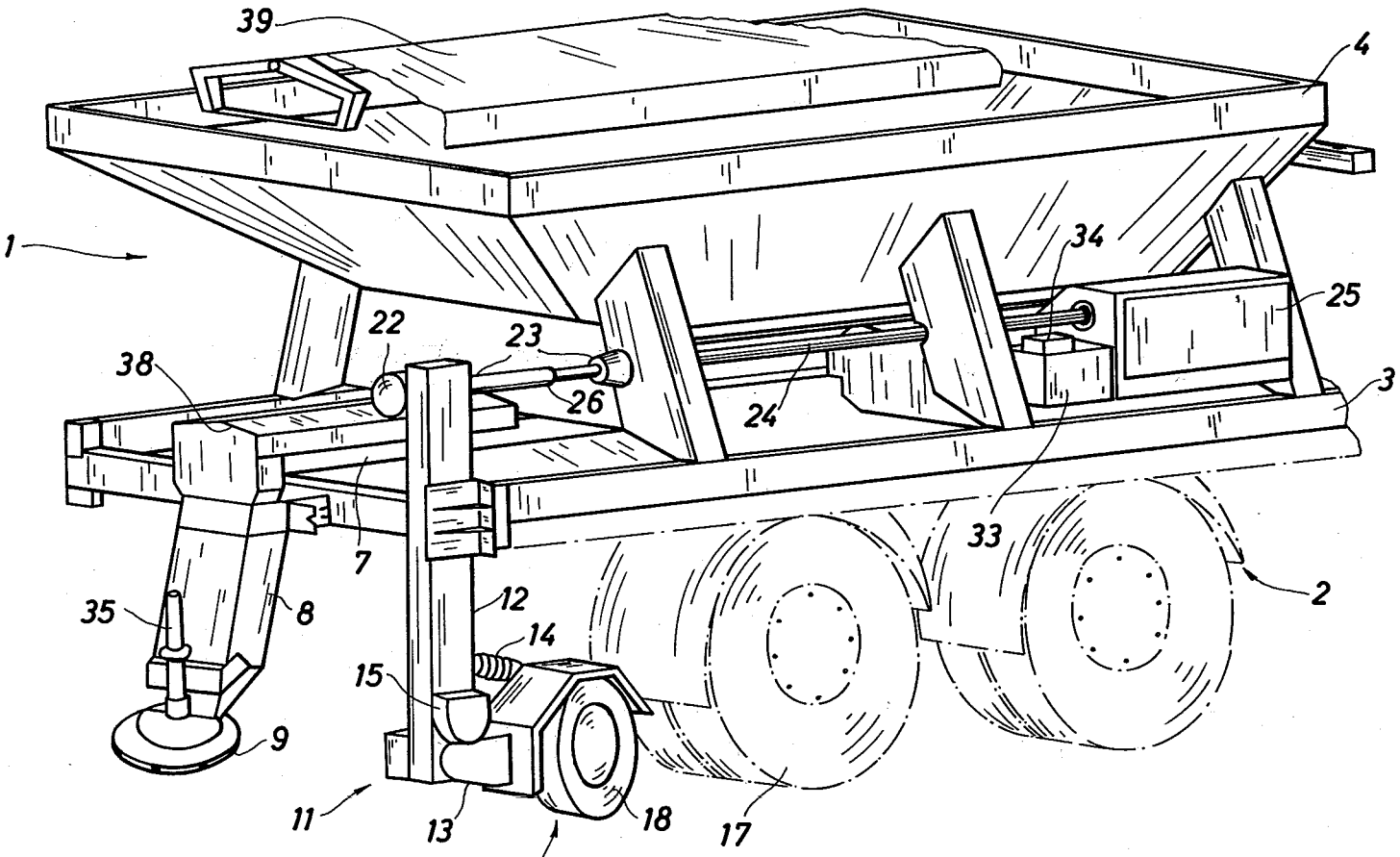
FIG. 1 is a perspective view of one form of the strewing apparatus.
Figure 2:
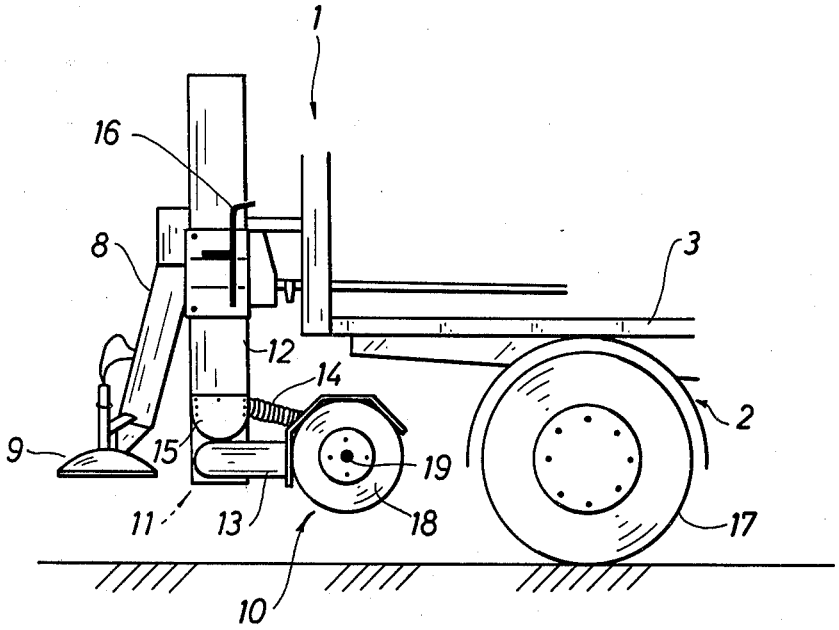
FIG. 2 is a lateral view of the rear portion of the apparatus.
Figure 3:
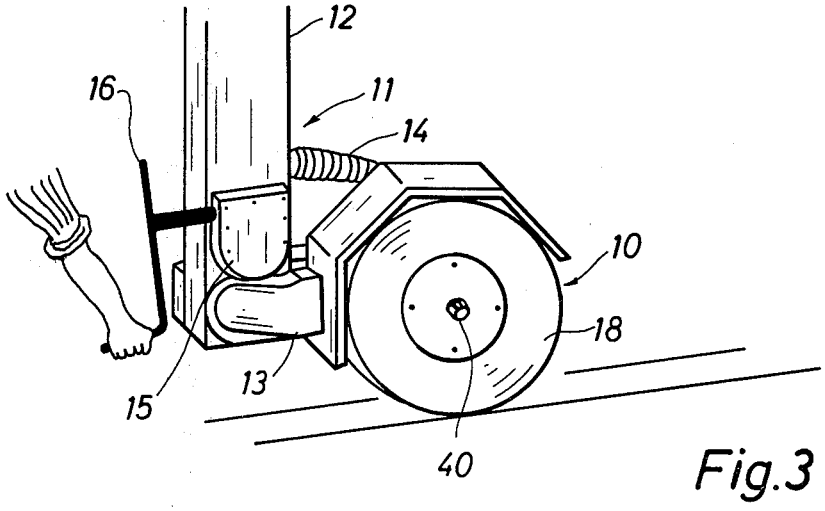
FIG. 3 shows the lowering of the rotating wheel in FIG. 1 onto the roadway.

In FIG. 1, a spinning spreading apparatus (1) is shown which is positioned onto a partially hidden truck (2) such as a tractor-trailer or trailer. A spreading substance container (4) having the form of an elongated right-angled funnel, is situated on a solid frame (3) of the apparatus, which can simultaneously also be a solid frame of the vehicle, upon appropriate supports. The substance contained in the container is distributed and, if necessary, pulverized, by means of a mixing roll (5) in accordance with FIG. 5, whereupon it proceeds to a spreading regulator situated underneath it. The spreading substance falls out of the spray regulator (6) in dosaged amounts onto the moving belt (7) in which manner it is transported to a conduit (8) adjustably attached to the back end of the frame (3) and through which it falls onto a spreading disc (9) at the lower end of the conduit (8). By turning the spreading disc (9) the substance is distributed evenly across an area which is dependant upon the rotation speed of the spreading disc.

A rotating wheel (10), positioned to be in contact with the roadway so that it rolls upon it, serves the purpose of a drive source for a dosing device, including the stirring roll (5), the spreading regulator (6), and the spinning disc (9) of the spinning strewing apparatus (1). The rotating wheel (10) is connected to the spinning strewing apparatus (1) by means of a compression leg (11) secured at the back end of the frame (3) made up of a vertical column (12) and a suspension arm (13) set at an angle at the lower end of the column whereby the rotating wheel is positioned at the other end of the suspension arm (13). The suspension arm (13) together with the rotating wheel (10) underneath the column (12) obtains its initial stress from a pressure spring (14) situated between the rotating wheel compartment and the column in the direction of the roadway. When not in use, the rotating wheel (10) is raised from the roadway. When the spreading apparatus is supposed to be in use the rotating wheel is lowered to the roadway by lowering the pressure spring (14) at the column (12) with the aid of a spindle gear which is activated by a hand lever (16). By turning the hand lever (16), the wheel is lowered until it touches the roadway close behind the rear wheel (17) of the truck. By further turning of the hand lever (16) at a pre-determined number of rotations, the pressure spring (14) is put under stress so that the rotating wheel (10) is lowered to the point where the rotating wheel (10) has a contact pressure of about 400 kg to the roadway. This axle load is common for larger passenger vehicles and serves to transfer the drive power of the vehicle to the roadway. Conversely, for the spinning spreading apparatus (1) there occurs a transfer of power from the roadway to the rotating wheel (10). Because a much smaller amount of power has to be transferred in this process, the grip of a commercially available tire (18) is sufficient for the rotating wheel (10). But because the spinning spreading apparatus will often be used on streets which are hard to drive upon, a large profile tire is used as a tire (18) which improves grip to the roadway, i.e., winter tires. Should the apparatus be used on grassy areas, the tire (18) of the rotating wheel (10) can be easily replaced with a very wide tire corresponding to reduced area pressure.

Figure 4:
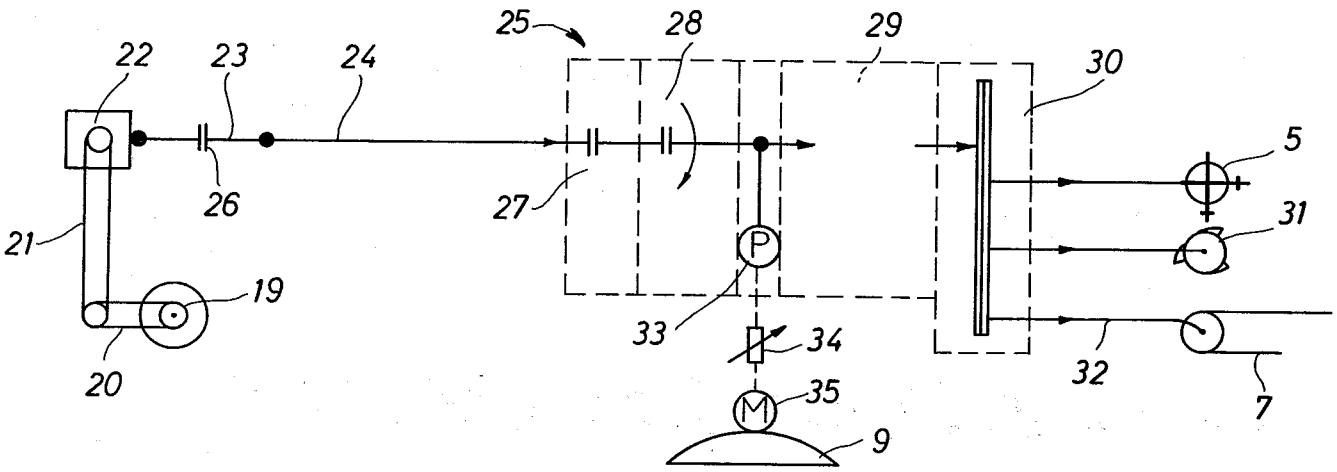
FIG. 4 is a schematic depiction of the power transfer in the apparatus.

With reference to FIG. 4, the power transfer in the spinning strewing apparatus (1) from the rotating wheel (10) to the elements using the power is described in particular below. According to the depiction in FIG. 4, the power transferred to the rotating wheel (10) first appears at the shaft (19) of the rotating wheel (10). From this it is transferred across a first chain gear (20), running alongside the suspension arm (13) to a second chain gear (21), running alongside the column (12). The rotation transferred by the second chain gear (21) around the axis perpendicular to the driving direction is converted by a pulley (22), situated at the upper end of the column (12) to a rotation on an axis with the driving direction which is then transferred across a shaft (23) to an entry shaft of the power distributor (25) of the power transfer device. The shaft (23) serves to allow a lateral shift of the column (12) without exchanging the elements used, thereby also allowing a shift of the rotating wheel (10) corresponding to the expected wheel base of the truck (2). In the shaft (23) there is also a device used for extending or shortening the shaft (which is not shown in the diagram) such as a toothed gear chain. In addition, an overload coupling (26) is built into the shaft which automatically interrupts the power transfer as soon as the strewing mechanism is blocked from the stirring shaft (5), the spreading regulator (6), the moving belt (7), and the spreading disc (9) or for any other reason. Therefore, in case of blockage, the entire power transfer device is protected so that, thereby, the individual elements of the power transfer device do not have to be built extra sturdy but rather can be designed to the disengagement limits of this overload coupling (26). Without attaching this overload coupling (26) this type of overload due to blockage of the spreading mechanism could be extremely serious because with the aforementioned axle load of 400 kg, a wheel of normal passenger vehicle size transfers up to 100 kW to the roadway whereas the actual performance capacity of the spreading mechanism is at about 3 kW so that normal capacities for the elements of the power transfer device is sufficient.

In the power distributor (25) the entry shaft leads first to a main coupling (27) which can be engaged or disengaged by the use of a manual lever directly or by the use of an undepicted electronic remote control mechanism from the driver's compartment of the vehicle or truck. An automatic switch gear is attached to the exit shaft of this man coupling (27) which always turns in the same direction on the exit side regardless of the rotation direction at the entry shaft. As a result of this automatic switch mechanism, personnel operating the spinning spreading apparatus (1) need not turn off the strewing mechanism or turn a switch by hand or by remote control when changing directions from forward to reverse. Thereby, the automatic switch gear simultaneously protects the entire strewing mechanism from damage which could occur from reverse drive, for example to the moving belt (7) or the spreading regulator (6). Furthermore, the entire spreading mechanism has only to be designed for operation in one rotation direction which facilitates construction and installation.

A change-over speed gear (29) is located behind the switch gear (28) which can be turned on or off by hand or by remote control for varying transfer conditions. The change-over speed gear (29) is connected to a chain gear (30) at its exit shaft which is designed as a double-chained gear and which transfers the power from the change-over speed gear (29) to the mixing shaft (5) then to a convertible shaft (31) (explained below), to the spreading regulator, and from a moving belt transmission shaft (32) for driving the moving belt (7). The chain gear (30) has a main chain cycle (which is not depicted in detail) which can be exchanged for spreading various substances when using the spin strewing apparatus (1). In this example, the chain gear (30) spins the mixing shaft with 40% of the rotation of the convertible roll, whereas it spins the transmission roll (32) for the moving belt (7) synchronically with the same rotation as the convertible roll (31). Therefore, the change-over speed gear (29) serves to regulate the substance to be spread, as dosaged by the spreading regulator (6) whereby the mixing roll (5) prepares and channels the substance to be spread synchronically whereas the moving belt (7) always obtains the same amount of spreading substance per unit of distance covered which leads to a simple and clear structure.

An oil pump (33), which powers an oil motor (35) for the spreading disc (9) is attached to the exit shaft of the automatic switch gear (28) in front of the change-over speed gear. By appropriately setting the amount regulator (34) the rotation of the spreading disc (9) and therefore the spreading width, can be changed. In the example used, the amount regulator is adjusted by means of an undepicted remote control unit either independently of an adjustment to the spreading regulator (6) by switching the change-over speed gear (29) or by automatically adjusting the dosage by means of the spreading regulator (6), which occurs by switching the change-over speed gear (29) in accordance with a change of the spreading width so that the substance per area unit remains constant by simultaneously changing the dosage and the spreading width. In the example used, an eightstage change-over speed gear is used which allows for a sufficiently fine gradation of the dosage in a factor range of roughly 1:10.

Figure 5:
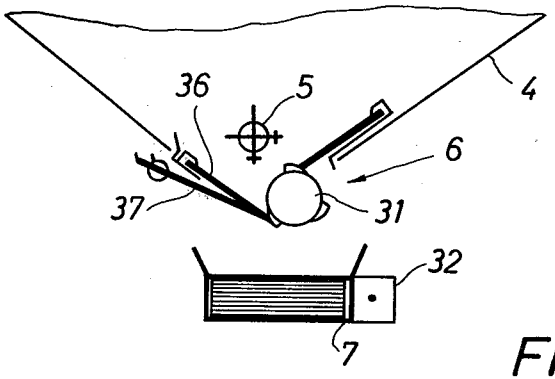
FIG. 5 is a schematic cross-sectional view of a spreading regulator of the apparatus.

According to FIG. 5, the convertible roll (31) of the dosage device is positioned alongside the base of the substance container (4) and moves a rubber floor (36) across the cogs attached there which is protected by adjustable springs (37). By means of the exchangeable cogs of the convertible roll, the rubber base of the substance container (4) can be opened to the degree regulated by the adjustable springs (37). Therefore, the springs (37) serve to set finely the amounts. The substance to be spread is channeled to the convertible roll (31) from the mixing roll (5) which is situated at a slant in the substance container (4) above the convertible roll (31) and distributes the substance evenly across the entire length of the convertible roll whereby any clumps in the substance are pulverized. The substance falling through the slot between the convertible roll (31) and the rubber base (36) lands on the transport belt (7) and is carried by this across the shaft (8) to the spreading disc (9). In the back section of the spinning strewing apparatus (1), the moving belt (7) and the substance upon it is protected on top and laterally by a covering (30) against snow and rain. The substance in the substance container (4) is kept as dry as possible with a schematically implied covering (39).

For changing the substance or for turning off the spinning strewing apparatus (1) it is necessary to empty the substance container (4). For this purpose the rotating wheel (10) is designed with an engagement shaft (40) to which any type of available power source can be attached externally. To empty the substance container (4), the rotating wheel (10) is powered after the conduit (8) has been removed and the spreading regulator (6) has been turned on to the desired flow amount by switching the change-over speed gear whereupon the substance is deposited or filled up at the end of the moving belt (7). Instead of the engagement shaft (40), a power hook-up can be used which leads from the power distributor (25) to the entry shaft. A special model of the spinning spreading apparatus (1) has an undepicted oil motor or hydraulic motor for emptying the substance container (4) which can be attached to an available hydraulic unit. When emptying, the spreading disc (9) is turned off. The spreading disc (9) is adjustable as to its height above the roadway in the model used for which reason the conduit (8) is built like a telescope out of two parts. Furthermore, the spreading disc (9) is adjustable with respect to the conduit (8) which allows for symmetrical or unsymmetrical strewing in one direction. This adjustment capacity of the spreading disc (9) for height and lateral position is facilitated by power from the oil motor (35) because when adjusting, only a flexible oil cable needs to be moved whereas on the other hand, with mechanical drive, adjustment in both directions would be complicated and time-consuming.

The model described above refers to a spinning spreading apparatus in which the spreading of a substance on the desired surface is done with the aid of a spreading disc whereby the substance is measured out in proportion to the area by the spreading regulator. The principle of the discovery, namely powering the spreading apparatus independently of the truck used by means of a rotating wheel in constant contact with the roadway can also be used with the same or similar advantages for spreading apparatus which function in accordance with the roller principle or also for spreading apparatus by means of which large amounts of substances are distributed in proportion to the area for the construction of roads or for solidifying roadways.

What is claimed is:

1. In combination with a ground-supported vehicle adapted to be moved along the surface of the ground, apparatus for spreading material comprising a container for the material to by spread mounted on the vehicle; at least one spreading disc rotatable about a vertical axis for receiving material to be spread and for spreading the received material onto the ground; an adjustable speed motor system having a rotary input and having a rotary output drivingly connected to the spreading disc; a material dosing device for discharging material from the container and conveying it to the spreading disc; a driving wheel mounted on the vehicle in a manner to be lowered into driving contact with the ground; a mechanical power transfer device having a rotatable input driven by rotation of the driving wheel, at least one first rotatable output drivingly connected to the dosing device and a second rotatable output drivingly connected to the input of the adjustable speed motor system.

2. A spreading apparatus placed on top of a vehicle, said apparatus comprising a substance container from which the substance is fed through a dosing device, characterized in having a combined power delivering and road distance sensing driving wheel situated at the back end of the vehicle and capable of being lowered to make contact with the roadway, said driving wheel being adapted to drive the dosing device through a mechanical power transfer device and being adapted to drive at least one spreading disc through a hydraulic, pneumatic or electric device connected to the power transfer device, said driving wheel having a shaft carried at one end of a suspension arm, the other end of said suspension arm being connected to the lower end of an essentially vertical column which is secured to the apparatus frame, said column and arm forming a compression leg which has elastic initial stress when in operation with regard to the roadway.

3. Apparatus according to claim 2 including a compartment for the driving wheel and including a pressure spring attached between the column and the wheel compartment.

4. Apparatus according to claim 3 wherein the starting point of the pressure spring at the column can be lowered.

5. Apparatus according to claim 4 wherein the starting point can be lowered by means of a spindle.

6. Apparatus according to one of claims 2 to 5 wherein the suspension arm juts out in a forward direction from the column.

7. Apparatus according to claim 6 wherein the power transfer device bears a first chain gear along the suspension arm attached to the shaft of the driving wheel, a second chain gear along the column attached to the first chain gear, a pulley attached to the second chain gear at the upper end of the column as well as a shaft attached to the pulley which leads to a coupling and gear unit of the power transfer device.

8. A spreading apparatus placed on top of a vehicle, said apparatus comprising a substance container from which the substance is fed through a dosing device, characterized in having a combined power delivering and road distance sensing driving wheel situated at the back end of the vehicle and capable of being lowered to make contact with the roadway, said driving-wheel being adapted to drive the dosing device through a mechanical power transfer device and being adapted to drive at least one spreading disc through a hydraulic pneumatic or electric device connected to the power transfer device, said dosing device including a spreading regulator having a cogged convertible roll located at the bottom of the substance container and driven by the power transfer device, a rubber base cooperating with said roll so as to be flexed during rotation of the roll, and adjustable spring means supporting the rubber base.

9. A spreading apparatus placed on top of a vehicle, said apparatus comprising a substance container from which the substance is fed through a dosing device, characterized in having a combined power delivering and road distance sensing driving wheel situated at the back end of the vehicle and capable of being lowered to make contact with the roadway, said driving-wheel being adapted to drive the dosing device through a mechanical power transfer device and being adapted to drive at least one spreading disc through a hydraulic pneumatic or electric device connected to the power transfer device, said dosing device including a spreading regulator, a conduit for discharging the substance on to the spreading disc and a moving belt for transporting the substance from the spreading regulator to the conduit.

10. Apparatus according to claim 9 wherein the power transfer device drives the moving belt synchronically with the spreading regulator.

11. Apparatus according to claim 9 or 10 wherein the power transfer device drives the moving belt to the end facing the conduit.

12. A spreading apparatus placed on top of a vehicle, said apparatus comprising a substance container from which the substance is fed through a dosing device, characterized in having a combined power delivering and road distance sensing driving wheel situated at the back end of the vehicle and capable of being lowered to make contact with the roadway, said driving-wheel being adapted to drive the dosing device through a mechanical power transfer device and being adapted to drive at least one spreading disc through a hydraulic pneumatic or electric device connected to the power transfer device, said dosing device including a spreading regulator and a mixing roll located in the lower portion of the substance container, the power transfer device driving the mixing roll and the spreading regulator.

* * * * *